United States Patent [19]

Büchel

[11] 4,077,556

[45] Mar. 7, 1978

[54] LATCHING ARRANGEMENT FOR THE FIRING PIN IN AN EXPLOSIVE POWDER CHARGE DRIVEN SETTING GUN

[75] Inventor: Franz Büchel, Rugell, Liechtenstein

[73] Assignee: Hilti Aktiengesellschaft, Schaan, Liechtenstein

[21] Appl. No.: 768,750

[22] Filed: Feb. 15, 1977

[30] Foreign Application Priority Data

Feb. 24, 1976 Germany ..... 2607436

[51] Int. Cl.[2] ..... B25C 1/14

[52] U.S. Cl. ..... 227/8; 227/10

[58] Field of Search ..... 227/8, 9, 10

[56] References Cited

U.S. PATENT DOCUMENTS 2,622,243 12/1952 Temple et al. ..... 227/9

3,248,032 4/1966 Bochman, Jr. ..... 227/8

3,923,225 12/1975 Maier et al. ..... 227/8

*Primary Examiner*—Granville Y. Custer, Jr.

*Attorney, Agent, or Firm*—Toren, McGeady and Stanger

[57] ABSTRACT

In an explosive powder charge driven fastening element setting gun, a barrel is displaceably mounted in a housing forward of a firing pin. By pressing the barrel rearwardly, it moves the firing pin into the cocked position. The firing pin is released from the cocked position by a latch which turns the firing pin about its axis. The latch includes a driving cam engageable with a lug extending laterally from the firing pin for rotating the firing pin. It also includes a return cam which guides the lug in its movement in its axial direction from the cocked position into the firing position.

10 Claims, 4 Drawing Figures

LATCHING ARRANGEMENT FOR THE FIRING PIN IN AN EXPLOSIVE POWDER CHARGE DRIVEN SETTING GUN

SUMMARY OF THE INVENTION

The present invention is directed to an explosive powder charge driven fastening element setting gun with an axially displaceable barrel and firing pin with the firing pin being cocked by pushing the barrel rearwardly against the force of a firing spring and the firing pin being released from the cocked position by turning it about its axis. More particularly, the invention is directed to a latch arrangement in engagement with the firing pin and actuated by a trigger on the gun for releasing the pin from its cocked position.

For reasons of safety, explosive charge driven setting guns are constructed so that the cartridges can be fired only when the muzzle end of the barrel bears against the receiving material into which a fastening element is to be driven. Especially suitable for such operations are setting guns with a displaceable barrel which can be pushed rearwardly into the gun housing when it is forced against the receiving material for cocking a firing pin within the housing against the force of a firing spring. When the firing pin is released from the cocked position, the firing spring biases it into the firing position for igniting a cartridge.

One possibility of releasing a cocked firing pin involves the use of a pawl holding the firing pin in its cocked position, the pawl is released by the trigger on the setting gun so that the firing pin strikes against the cartridge. This arrangement has the disadvantage that it requires a considerable length for the setting gun.

To limit the length of the setting gun, another type of release is preferred which involves releasing the cocked firing pin by causing it to rotate. This operation is effected by providing a projection on the firing pin which cooperates with a part of the barrel for cocking the firing pin against the force of a spring when the barrel is pushd rearwardly into the gun housing. Another projection is provided on the firing pin which cooperates with a latch actuated by the trigger of the gun so that the latch can impart rotary movement to the firing pin about its axis, that is, the axis extending in the firing direction of the gun. By rotating the firing pin, its projection cooperating with the barrel is displaced out of the axial range of action of the barrel and the pin is biased forwardly against the cartridge by the firing spring.

To prevent release of the firing spring when the muzzle end of the barrel is not completely pressed against a receiving material, that is, when the barrel has started to cock the firing spring but has not been fully depressed into the gun housing by pressure against the receiving material, a safety device is provided in this preferred type setting gun using a rotatable firing spring and the device protrudes into a recess of the pin. As long as the safety device acts on the firing pin in its recess, rotation and release of the pin is prevented. This safety device is connected with the barrel and is disengaged from the recess in the firing pin only when the barrel is completely pressed rearwardly into the gun housing.

Providing such a safety device involves considerable additional costs for setting guns. Moreover, use of the safety device increases the susceptibility to problems with such guns and includes an additional uncertainty factor because of the possible failure of the device.

The primary object of the present invention is to provide a powder charge driven setting gun employing a rotatable firing pin which offers a maximum amount of safety with a minimum of engineering effort.

In accordance with the present invention, this object is achieved by providing a latch for displacing the firing pin which has a driving cam and a return cam acting on a radially projecting lug on the firing pin. The driving cam is in operating relationship with the lug only when the firing pin is cocked while the return cam is positionable into contact with the lug over its entire length of axial movement between the firing position and the cocked position.

While the firing pin is cocked in a known manner by the barrel or a part connected with the barrel acting on a projection on the firing pin, in accordance with the invention, the firing pin also has a projecting lug. The lug is displaceable by the latch which, in turn, is displaced, in a known manner, by the setting gun trigger. The two cams on the latch operate to impart to the firing pin a rotary movement about its axis with each cam providing the firing pin with movement in one direction.

Since the firing pin also performs an axial movement, the axial position of the radially projecting lug on the pin is variable. The return cam is dimensioned so that it can engage the lug over the entire axial displacement path of the firing pin, that is, between its firing position and cocked position. On the other hand, the driving cam is arranged so that it acts on the lug only when the firing pin is fully displaced into its cocked position. As a result, the firing pin can only be released for rotational movement when it is completely cocked, that is, when the barrel has been completely pressed rearwardly into the gun housing. If the trigger is squeezed before the firing pin is fully cocked, it is not possible for the driving cam to act on the lug and the firing pin cannot be released for movement into the firing position. The arrangement of the return cam relative to the driving cam ensures, however, that the firing pin is returned into its original position as soon as the barrel or the part connected with it has released the projection on the firing pin.

In a simple arrangement of the present invention, the latch is displaceably mounted in a plane extending parallel to the elongated or firing axis of the firing pin. To avoid the use of any additional means which could be susceptible to operating problems, the displacement plane is arranged parallel to the plane of movement of the trigger, so that the trigger can act directly on the latch.

Another feature of the invention is the provision of a return spring for urging the latch toward the trigger for effecting an automatic return of the firing pin via the return cam. Additionally, due to the cooperation between the latch and the trigger, the trigger is always biased into its original position by the force of the return spring.

To ensure safe operation, it is preferably to mount the latch so that it pivots in a plane which is parallel to the plane of its linear displacement. In this way it is impossible for the latch to turn the firing pin through the radially projecting lug by any existing friction influences. Further, this mounting of the latch prevents any damage to cooperating parts by pushing back the barrel when the latch is only partly engaged.

To afford cooperation with a cocking pin connected to or secured on the barrel, the firing pin preferably has a radially protruding projection. In terms of load, it is advantageous if the location of the projection for cocking the firing pin protrudes radially outwardly from the firing pin on the diametrically opposite side from the radially projecting lug which engages the driving cam and the return cam.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
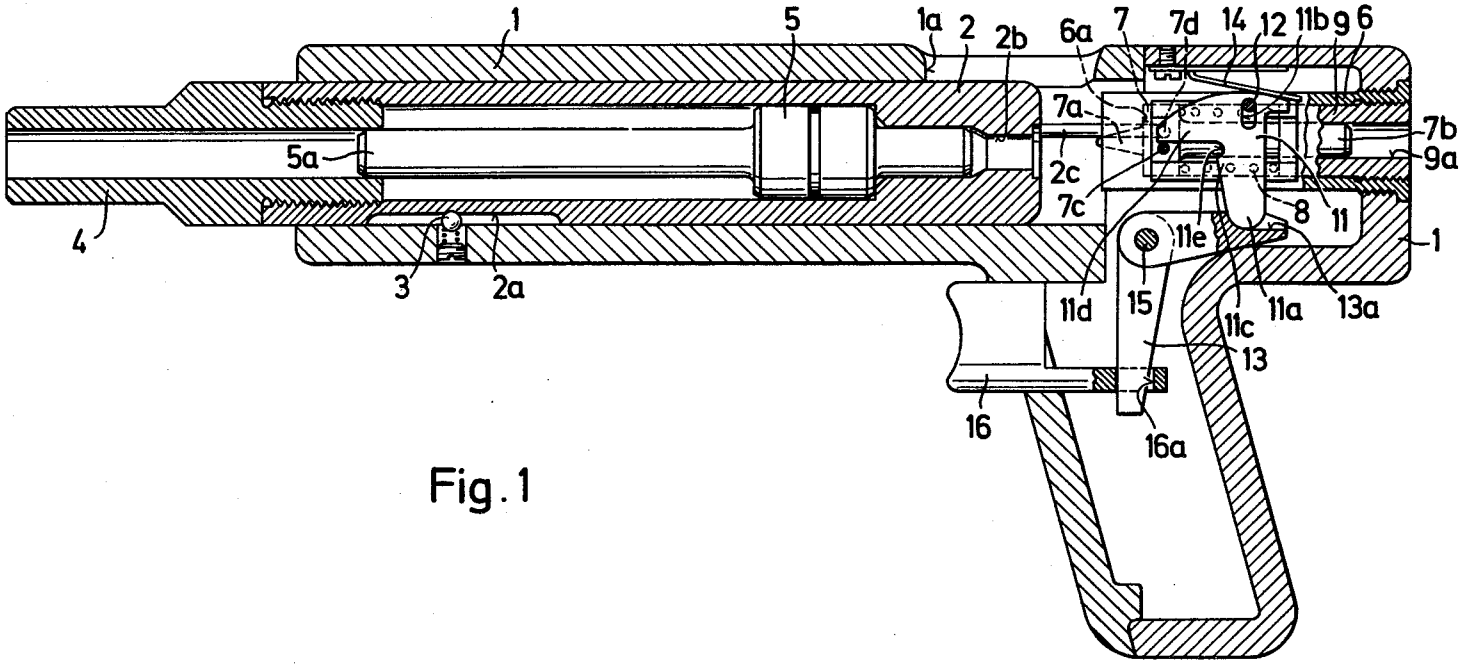
FIG. 1 is an axially extending cross sectional view of a setting gun with the gun disposed in the rest position.

In the drawing an explosive powder charge driven fastening element setting gun is illustrated consisting of a housing 1, formed of two parts for manufacturing reasons, with a barrel 2 axially displaceably mounted within the housing. As viewed in FIGS. 1, 2 and 3, the left hand end of the setting gun is its forward end and the right hand end of the setting gun is its rearward end. The displaceability of the barrel is limited by the cooperation of a ball retainer 3 biased into an axially extending groove 2*a* adjacent the forward end of the barrel. Threaded into and extending forwardly from the forward end of the barrel is a muzzle tube 4 arranged to receive a fastening element to be inserted by the setting gun. A driving piston 5 is axially displaceably mounted within the barrel 2 and has a forward end positioned within the muzzle tube. When the gun is fired, the driving piston 5 is propelled forwardly through the barrel with its shaft 5*a* moving through the muzzle tube 4 for driving a fastening element 18, note FIG. 2, into a receiving material 17. The rearward end of the barrel 2 has a cartridge chamber 2*b* and, in addition, a cocking pin 2*c* projects to the rear from the rearward end of the barrel.

A bush 6 is screwed into the rear part of the housing 1 and a firing pin 7 is mounted within the axial bore of the bush for limited axial displacement and also for rotation. Biasing the firing pin in the forward or firing direction is a firing spring 8 located in the forward end 6*a* of the bush. In the rest position of the gun shown in FIG. 1, a conically shaped firing tip 7*a* projects slightly forwardly of the front end of the bush 6. Extending axially forwardly from the rearward end of the bush is a tube 9 threaded into the bush. Tube 9 has a centrally arranged axially extending bore 9*a* in which a rear shaft section 7*b* of the firing pin is guided. Extending laterally from the side of the firing pin 7, as viewed in FIG. 1. is a radially protruding lug 7*c* and a radially protruding nose 7*d* extends from the diametrically opposed side of the pin. When the barrel 2 is pressed rearwardly into the housing 1 its cocking pin 2*c* strikes against the projection or nose 7*d* and forces the firing pin rearwardly against the force of the firing spring and holds the pin in the cocked position. On the opposite side of the firing pin from the nose 7*d*, the lug 7*c* is in operative engagement with a latch 11. Latch 11 is mounted on a guide pin 12 located within the housing and it has a downwardly extending protuberance 11*a* which engages in a slot 13*a* of a swivel lever 13 also mounted in the gun housing. A return spring 14 mounted in the housing 1 above the firing pin, maintains the protuberance 11*b* of the latch 11 in permanent engagement in the slot 13*a*. Latch 11 has an oblong slot 11*b* extending transversely of the firing direction of the gun and the guide pin 12 extends through the slot. The engagement of the pin 12 within the slot 11*b* permits the latch 11 to move in a rectilinear direction and also to pivot in the plane of its rectilinear displacement. Additionally, the latch 11 has a driving cam 11*c* and a return cam 11*d* disposed in operative engagement with the lug 7*c* for effecting the rotation of the firing pin when the latch 11 is displaced.

Swivel lever 13 is pivotably mounted in the housing on an axle 15, one arm of the lever contacts the protuberance 11*a* on the latch and the other arm of the lever projects downwardly and engages in an opening 16*a* of a trigger 16 displaceably mounted in the handle part of the housing 1.

Figure 2:
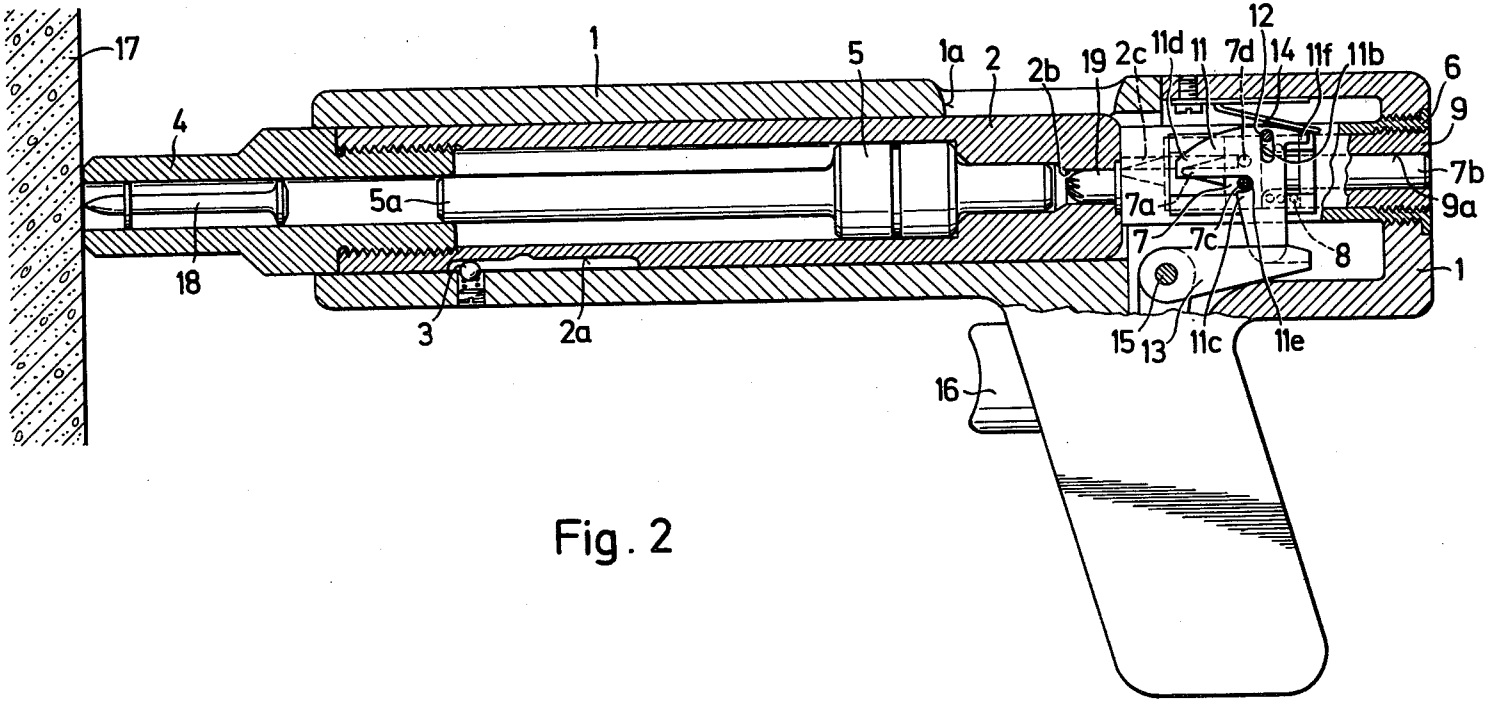
FIG. 2 is a view similar to FIG. 1, however, showing the gun only partly in section and arranged in the cocked position.

In FIG. 2 the setting gun is shown with the forward end of the muzzle tube 4 pressed against the receiving material 17. A fastening element 18 is inserted within the muzzle tube and has the form of a nail. At the rearward end of the barrel 2, a cartridge chamber 2*b* contains a cartridge 19 which has been introduced manually through an inlet-outlet opening 1*a* in the upper side of the housing when the barrel has been pulled forwardly. Note in FIG. 2 that the ball retainer 3 is in the forward end of the groove 2*a*, if the barrel is pulled forwardly the ball retainer would be located in the rearward end of the groove.

As the barrel 2 is displaced from the rest position shown in FIG. 1 into the position shown in FIG. 2, the cocking pin 2*c* has displaced the firing pin 7 in the rearward direction due to its contact with the projection 7*d* against the biasing action of firing spring 8. Lug 7*c* has also moved in the rearward direction along return cam 11*d* into a recess 11*e* in the latch formed at the intersection of the driving cam and the return cam. In FIG. 2 the firing pin has been cocked and held in that position by the action of the pin 2*c* against the projection 7*d* on the firing pin. When the trigger 16 is squeezed into the handle of the housing with the gun position shown in FIG. 2, the swivel lever is pivoted in the counterclockwise direction. This movement of the lever displaces the latch 11 in the upward direction with the oblong slot riding over the guide pin 12. The upward movement of the latch is effected against the biasing force of the return spring 14. This upward movement of the driving cam 11*c* entrains the lug 7*c* within the recess 11*e* and the firing pin turns about its axis. Due to the rotation of firing pin 7, its projection 7*d* is disengaged from the cocking pin 2*c* and, as a result, firing spring 8 forces a firing pin 7 forwardly from the cocked position into the firing position for igniting the cartridge 19.

Figure 3:
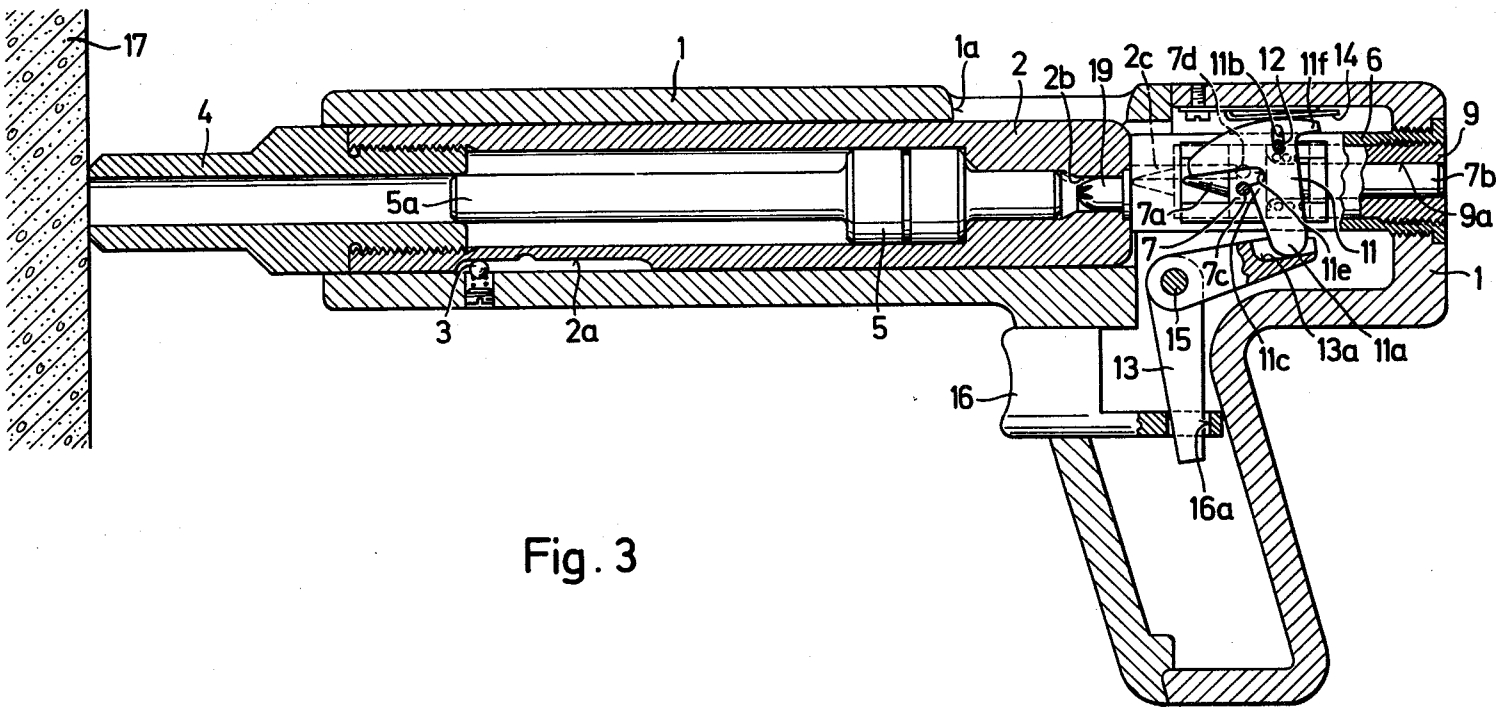
FIG. 3 is a view similar to FIG. 2, however, with the setting gun shown fully in cross section and with the barrel pressed rearwardly and the trigger squeezed.
Figure 4:
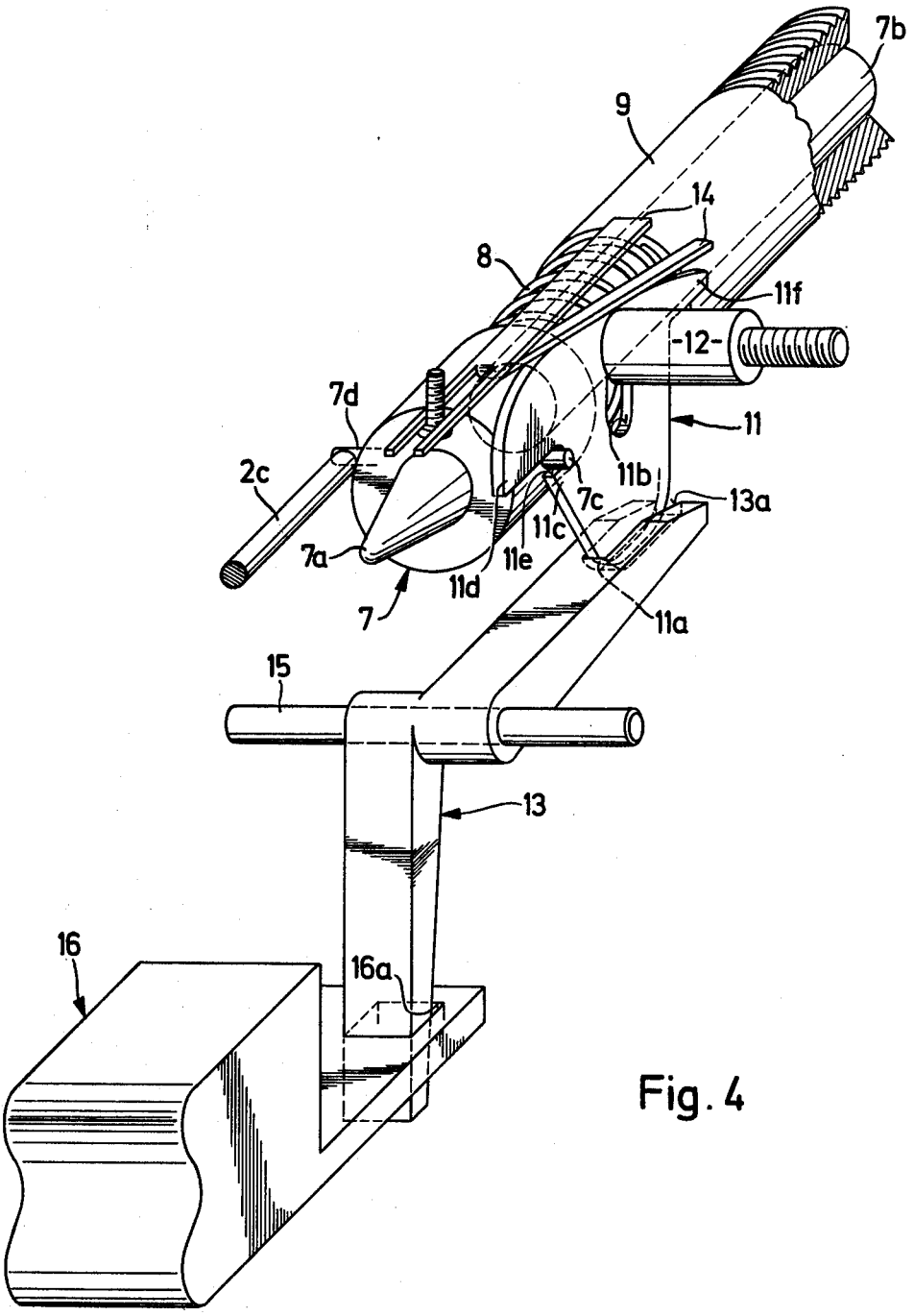
FIG. 4 is a perspective view of a portion of the setting gun constituting the firing gun and illustrated in accordance with the position shown in FIG. 2.

In FIG. 3 the setting gun is shown in a position where the trigger 16 has been pulled or squeezed and then the barrel has been pressed against the receiving material moving it rearwardly into the housing. The following explains that with such a reversal in the operating procedure of the setting gun it is not possible for the cartridge 19 to be fired. As was indicated above, when the trigger is squeezed, the latch has been moved upwardly due to the interaction of the oblong slot 11*b* and the guide pin 12 against the action of the superposed return spring 14. The barrel 2 and muzzle tube 4 are pressed rearwardly so that the barrel recedes into the housing 1 moving toward its rearward end. With such movement, the firing pin has been entrained by the action of cocking pin 2*c* acting against its projection 7*d*. The latch 11, however, has already been displaced against the return spring 14 and, accordingly, lug 7*c* cannot engage in recess 11*e* but instead, as can be seen in FIG. 3, it contacts the forward downwardly extending surface of the driving cam 11*c*. Since the lug 7*c* is not engaged within the recess 11*e*, the latch, because of the displacing action imparted to it by the swivel lever 13, is turned counterclockwise about the guide pin 12 which acts as a pivot axis. Due to its pivotal movement, the latch 11 adapts the position shown in FIG. 3. In the illustrated position, it is not possible for the driving cam 11*c* to effect an upward movement of the lug 7*c* preventing rotation of the firing pin 7 about its axis. As a result, cocking pin 2*c* remains in contact with the projection 7*d* and maintains the firing pin 7 in spaced relation from the cartridge 19. In FIG. 4 the firing mechanism is represented without the bush 6 to illustrate its method of operation.

In the various figures, it can be noted that the firing pin includes the forwardly extending firing tip 7*a* and its rearwardly extending reduced diameter shaft section 7*d* which traverses tube 9. Extending between the forward end of tube 9 and the forward region of the firing pin 7 is the firing spring 8. As indicated previously, the firing pin has a lug 7*c* extending from one lateral surface and projection or nose 7*d* extending from the opposite surface. These two separate parts can, for example, be the opposite ends of a pin disposed transversely of the firing pin. In FIG. 4 the cocking pin 2*c*, secured to the barrel (not shown), acts against the projection 7*c*. The lug 7*e* is shown seated within recess 11*e* of the latch and it is entrained or positioned to be displaced by the driving cam 11*c* with the displacement action being guided within the oblong slot 11*b* by the guide pin 12. When the latch is displaced by the lever 13, the firing pin 7 is rotated and its projection 7*d* is disengaged from the cocking pin 2*c* so that the firing pin 7 is driven from the cocked position by the firing spring 8 into the firing position for igniting the cartridge 19.

From the firing position, firing pin 7 is returned by means of the return cam 11*d* into the position shown in FIG. 1, this movement takes place automatically after the squeezing action on the trigger 16 is released. The return of the latch 11 to its original position is effected by the return spring 14. Another function of the return spring is to ensure the permanent engagement of protuberance 11*a* in slot 13*a* in the arm of the swivel lever 13 extending generally in the horizontal direction as shown in the drawings. Further, return spring 14 functions to move the trigger 16 into its starting position over the latch 11 and the swivel lever 13. The return spring 14 can be designed as a leaf spring, as shown, however, a coil spring acting on the arm 11*f* and pulling latch 11 against swivel lever 13 is also suitable.

While specific embodiments of the invention have been shown and described in detail to illustrate the application of the inventive principles, it will be understood that the invention may be embodied otherwise without departing from such principles.

What is claimed is:

1. Explosive powder charge driven fastening element setting gun comprising a housing having a forward end and a rearward end, a barrel mounted within said housing and extending from the forward end toward the rearward end thereof, said barrel having an axially extending bore therein with said barrel being displaceable within said housing in the axial direction of the bore, an axially extending firing pin displaceably mounted in said housing and aligned rearwardly of said barrel, said firing pin being displaceable between a cocked position and a firing position, a firing spring located in said housing and biasing said firing pin toward the forward end of said housing into the firing position, said firing pin being movable into the cocked position by displacing it in the rearward direction of said housing against the biasing action of said firing spring, a latch displaceably mounted in said housing, a trigger disposed in said housing in contact with said latch for displacing said latch, said latch arranged to rotate said firing pin about the axis thereof for releasing the firing pin from the cocked position, wherein the improvement comprises a lug secured to and extending laterally outwardly from said firing pin, said latch comprising a driving cam engagable with said lug to rotatably displace said firing pin, and a return cam extending transversely of said driving cam and arranged to contact said lug, said driving cam being engageable with said lug only when said firing pin is in the cocked position and said return cam being engageable with said lug in the axial direction of said firing pin for the range of movement of said firing pin from the cocked position into the firing position.

2. Explosive powder charge driven fastening element setting gun, as set forth in claim 1, wherein said latch is linearly displaceable within said housing in a plane disposed in parallel with the axis of said firing pin.

3. Explosive powder charge driven fastening element setting gun, as set forth in claim 2, wherein a return spring is located within said housing and disposed in contact with said latch for biasing said latch in the opposite direction to which it is displaceable by said trigger.

4. Explosive powder charge driven fastening element setting gun, as set forth in claim 1, wherein a guide pin is positioned within said housing, said latch being pivotally mounted on said guide pin for pivotal movement in the plane in which it is linearly displaceable.

5. Explosive powder charge driven fastening element setting gun, as set forth in claim 1, wherein said barrel has a cocking pin extending axially from the rearward end thereof toward said firing pin, and said firing pin having a projection thereon disposed in the path of movement of said cocking pin as said barrel is moved rearwardly so that said cocking pin contacts said projection and displaces said firing pin rearwardly into the cocked position.

6. Explosive powder charge driven fastening element setting gun, as set forth in claim 4, wherein said latch has an elongated slot therein with the elongated direction of said slot extending transverse of the axial direction of said firing pin, and said guide pin being located within said slot for guiding said latch during linear displacement thereof and said latch being rotatable about said guide pin.

7. Explosive powder charge driven fastening element setting gun, as set forth in claim 1, wherein said trigger is located below said firing pin, and an L-shaped lever is pivotally mounted in said housing below said firing pin and engageable with said trigger so that by moving said trigger said L-shaped lever is pivoted, said L-shaped lever engaging said latch for linearly displacing said latch and for pivoting said latch.

8. Explosive powder charge driven fastening element setting gun, as set forth in claim 7, wherein said driving cam extends downwardly below said firing pin into contact with said L-shaped lever and said return cam extends in the axial direction of said firing pin and extends from said driving cam toward the forward end of said housing.

9. Explosive powder charge driven fastening element setting gun, as set forth in claim 8, wherein said driving cam and said return cam intersect and form a recess at the intersection thereof for receiving said lug when said firing pin is in the cocked position.

10. Explosive powder charge driven fastening element setting gun, as set forth in claim 1, wherein a bush is secured in the rearward end of said housing and extending in coaxial relation with and laterally enclosing said firing pin, a tube threaded into the rear end of said bush, said firing pin having a rear shaft section slidably mounted in said tube and the rearward end of said spring disposed in contact with the forward end of said tube and the rearward end of said firing pin.

* * * * *